US010780698B2

(12) United States Patent
Cumbie, Jr. et al.

(10) Patent No.: US 10,780,698 B2
(45) Date of Patent: Sep. 22, 2020

(54) INVERTED TIJ

(71) Applicant: HEWLETT-PACKARD DEVELOPMENT COMPANY, L.P., Houston, TX (US)

(72) Inventors: Michael W Cumbie, Jr., Albany, OR (US); Chien-Hua Chen, Corvallis, OR (US); Erik D. Torniainen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/073,146

(22) PCT Filed: Jun. 29, 2016

(86) PCT No.: PCT/US2016/040161
§ 371 (c)(1),
(2) Date: Jul. 26, 2018

(87) PCT Pub. No.: WO2018/004573
PCT Pub. Date: Jan. 4, 2018

(65) Prior Publication Data

US 2019/0111680 A1 Apr. 18, 2019

(51) Int. Cl.
*B41J 2/16* (2006.01)
*B41J 2/14* (2006.01)

(52) U.S. Cl.
CPC ..... *B41J 2/164* (2013.01); *B41J 2/1404* (2013.01); *B41J 2/14056* (2013.01); *B41J 2/14072* (2013.01); *B41J 2/1603* (2013.01); *B41J 2/1628* (2013.01); *B41J 2/1631* (2013.01); *B41J 2/1632* (2013.01); *B41J 2/1635* (2013.01)

(58) Field of Classification Search
CPC ..... B41J 2/164; B41J 2/14072; B41J 2/1635; B41J 2/1631; B41J 2/1628; B41J 2/14056; B41J 2/1632; B41J 2/1603; B41J 2/1404
See application file for complete search history.

(56) References Cited

U.S. PATENT DOCUMENTS

| | | | |
|---|---|---|---|
| 4,878,992 A | 11/1989 | Campanelli | |
| 2003/0095165 A1 | 5/2003 | McClelland et al. | |
| 2004/0100522 A1 | 5/2004 | Horvath et al. | |
| 2004/0125171 A1 | 7/2004 | Hsu et al. | |
| 2012/0154486 A1 | 6/2012 | Anderson et al. | |
| 2014/0192118 A1* | 7/2014 | Cruz-Uribe | B41J 2/14233 347/71 |

FOREIGN PATENT DOCUMENTS

| | | |
|---|---|---|
| CN | 1389348 | 1/2003 |
| EP | 1308285 A2 | 5/2003 |
| JP | 02184451 | 7/1990 |
| JP | 04146153 | 5/1992 |
| JP | 06008442 | 1/1994 |
| JP | 2003145772 | 5/2003 |
| JP | 2006036865 | 2/2006 |
| JP | 2006187922 | 7/2006 |
| JP | 2008143132 | 6/2008 |
| JP | 2013538446 | 10/2013 |
| WO | WO-2012018561 | 2/2012 |
| WO | WO-2014098855 | 12/2012 |
| WO | WO-2015163893 | 4/2014 |

* cited by examiner

*Primary Examiner* — Scott A Richmond
(74) *Attorney, Agent, or Firm* — Trop, Pruner & Hu, P.C.

(57) ABSTRACT

A fluid ejection die includes a substrate including an array of nozzles.

20 Claims, 8 Drawing Sheets

INVERTED TIJ

BACKGROUND

Fluid ejection dies such as printhead dies are composed of a substrate and thin film layers. The thin film layers are disposed on the substrate and may include at least one chamber layer and a nozzle plate with nozzles. Actuators such as heat resistors are provided in ejection chambers of the chamber layer to eject the fluid out of the chambers through the nozzles. The substrate is doped and thin film circuitry is patterned throughout the thin film layers.

A flexible electrical circuit may extend around or next to the die to connect to bond pads of the die. The flexible electrical circuit may route electrical connections to a further printer circuit such as a controller. In a typical printhead, part of the electrical connections between the flexible circuit and die are provided on the head side of the die, for example using bond pads near an edge of the substrate.

Fluid supply slots run through the substrate. The fluid supply slots supply fluid to the channels and chambers in the thin film layers. The channels may include a manifold to fluidically connect a fluid supply slot to individual ejection chambers. During fluid ejection, fluid runs through the slots, the manifold channel, and into the ejection chambers. The heat resistors heat the fluid in the chambers, thereby forming vapor bubbles that push the fluid out of the nozzles. The nozzle plate may have a protective coating to prevent mechanical or chemical damage, e.g., from ink, crusted ink, servicing, wiping, etc.

DRAWINGS

DESCRIPTION

Figure 1:
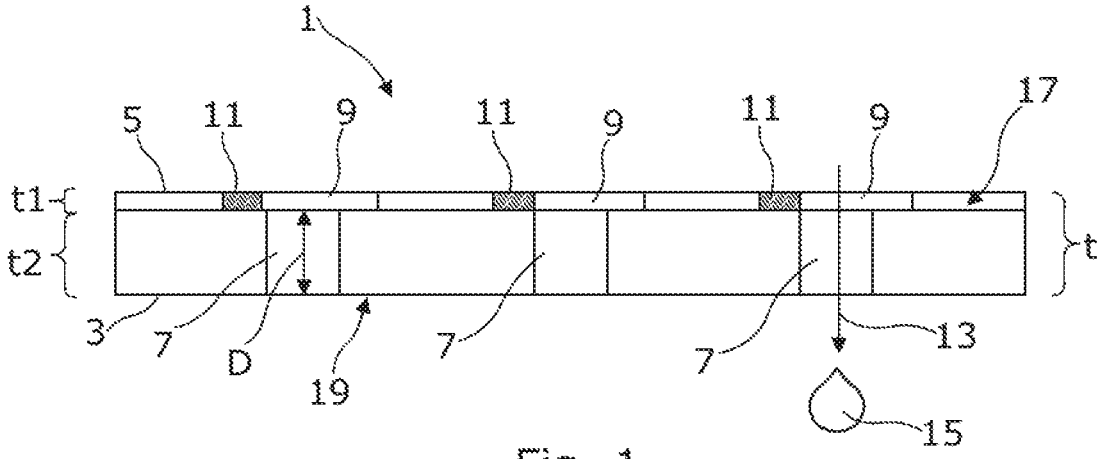
FIG. 1 illustrates a diagram of an example of a fluid ejection die.

FIG. 1 illustrates a diagram of an example of a fluid ejection die 1. In one example, the fluid ejection die is a MEMS (Micro-Electromechanical System). The die 1 includes a substrate 3 and at least one thin film layer 5. The at least one thin film layer 5 is disposed on the substrate 3. The at least one thin film layer 5 may be a thin film layer stack including thin film circuitry and fluid channels, thereby forming a MEMS. In an example, the substrate 3 includes silicon and the at least one thin film layer 5 includes SU8, dielectric, polymide, metal, or other polymer materials.

The substrate 3 includes a nozzle array of ink ejection nozzles 7. The thin film layer 5 includes fluid channels including ejection chambers 9. The ejection chambers 9 are fluidically connected to the nozzles 7. The thin film layer 5 includes fluid ejection circuitry. The fluid ejection circuitry includes thin film fluid ejection actuators 11 to eject the fluid from out through the nozzles 7. The actuators 11 are disposed upstream of the nozzles 7, in the chambers 9. At least one actuator 11 is disposed in each chamber 9. At least one actuator 11 is associated with each nozzle 7. The fluid ejection circuitry may further include electrical drive circuitry, such as fire wires, connected to the actuators 11. As indicated by fluid flow direction 13 and fluid drop 15, fluid is ejected from the fluid chambers 9 and/or channels in the at least one thin film layer 5, through the nozzles 7 in the substrate 3.

Different effects can be associated with such a fluid ejection die 1 wherein the substrate 3 is provided downstream of the at least one thin film layer 5. In one example, electrical bond pads or contacts of the die 1 can be provided at an upstream side 17 of the substrate 3, opposite to a head surface 19. Thereby electrical contacts or electrical circuitry protruding from the head surface 19 can be inhibited. Also, since the substrate 3 can form the nozzle plate instead of thin film layers, such novel nozzle plate can facilitate a relatively flat fluid ejection die head surface 19 as compared to head surfaces formed by thin film layer stacks. Hence, the head surface 19 can be relatively flat due to one or both of (i) an absence of electrical interconnect components protruding from the head surface and (ii) a silicon substrate that may act as nozzle plate surface.

One other example effect is that the substrate 3 functions as a shield, for example for the thin film circuitry behind it, for example with few or no additional layers needed on the head surface to protect it, although protective coating may be provided for different reasons. In an example wherein the substrate 3 is mostly composed of silicon, the substrate 3 can be relatively robust against potential negative chemical influences of the ejected fluids, e.g., ink, without needing an additional coating. Also the substrate 3 can provide for a nozzle plate that is relatively robust against heat, which may facilitate functioning in a relatively hot environment. In one example substrate nozzle plates may be more robust against heat than SU8 thin film nozzle plates. In another example, a head surface formed by the silicon substrate 3 may inherently be robust against mechanical handling, such as servicing procedures such as wiping, or may be more robust against nozzle tape removal. Other substrate materials, such as glass, may have similar effects.

In one example, the substrate 3 may be a relatively thin substrate 3, and/or a substrate 3. In a further example, the substrate 3 can be of a reduced thickness as compared to an original thickness of an original wafer that was used to produce the substrate from. In one example a thinner substrate 3 may facilitate an appropriate depth of the nozzles to facilitate appropriate nozzle functioning. As a consequence the die 1 may also be relatively thin. For example the total thickness t of the die 1 can be approximately 500 micron or less, approximately 300 micron or less, approximately 200 micron or less, or approximately 150 micron or less. In one example such a relatively thin die 1 is referred to as a thin sliver die. For example the die may be relatively flexible and may need a packaging for support and/or reinforcement.

A thickness t2 of the substrate 3 may be more than a total thickness t1 of the thin film layers 5, wherein the sum of these thicknesses t1, t2 forms the total thickness t of the die 1. In one example a depth D of each nozzle 7, formed through the substrate 3, between the upstream side 17 and the head surface 19, is more than a total thickness t1 of the thin film layer stack 5 of the die 1.

Figure 2:
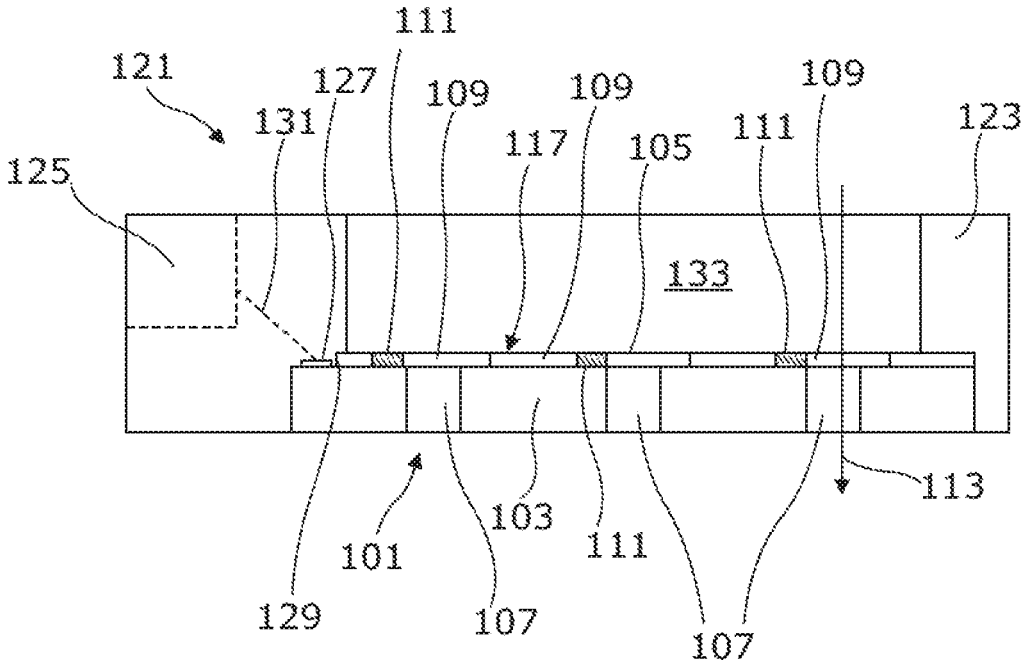
FIG. 2 illustrates a diagram of an example of a fluid ejection device.

FIG. 2 illustrates a diagram of an example of a fluid ejection device 121 including a fluid ejection die 101. The fluid ejection die 101 may include all features discussed with reference to the example die of FIG. 1. In the example of FIG. 2, the die 101 is supported by, or embedded in, a carrying structure such as packaging 123. The packaging 123 embeds or supports further electronic components 125, such as drive circuitry for the die 101. The die 101 includes a contact 127 on an upstream side 117 of its substrate 103. This contact 127 is wired to the further electrical components 125, from the upstream substrate side 117 to the component 125, whereby the electrical interconnection, e.g., wiring 131, is inhibited from protruding from a head surface 119 of the device 121. All electrical interconnections can be fully shielded by the substrate 103 and/or packaging 123. For example the electrical interconnect wiring 131 can be embedded in the packaging 123. The contact 127 may be disposed directly on the upstream side 117 of the substrate 103, for example next to the thin film layers 105, for example near an edge 129 of the substrate 103. In another example the contact 127 can be disposed on the thin film layers 105, for example near the edge of the thin film layers 105 and/or substrate 103.

The packaging 123 may further comprise a fluid supply slot 133 to supply fluid to fluid channels and/or chambers 109 of the thin film layers 105. Actuators 111 in the chambers 109 are to eject the supplied fluid through nozzles 107 in the substrate 103. The thin film layers 105 extend between the packaging 123 and the substrate 103, and/or between the fluid supply slot 133 and the substrate 103, so that in use fluid flows from the packaging 123 to the thin film layers 105, engaging first packaging walls 123 and subsequently thin film layer walls such as chamber or channel walls. The fluid flows from the thin film layers 105, out of the ejection chambers 109, through the substrate 103, as indicated with fluid flow direction arrow 113. Nozzles 107 are provided through the substrate 103, fluidically connected to the chambers 109, to eject the fluid out through the nozzles 107 by actuation of the actuators 111. Actuation of the actuators 111 may be driven by drive circuitry of the electric component 125 and/or in the thin film layers 105.

Where the die 101 is placed in or on the packaging 123, adhesive can be provided between the die 101 and packaging 123, around the at least one fluid supply slot 133. The adhesive may adhere to the thin film layers 105 on one side, and to the packaging 123 one the other side. The electrical interconnect wiring 131 can at least partly extend through the adhesive and/or encapsulate. In another example the die 101 can be directly overmolded in the packaging 123. The electrical interconnect wiring 131 and/or electrical component 125 can be directly overmolded in the packaging 123 together with the die 101. Instead of a packaging 123 any other suitable carrying structure can be used.

Figure 3:
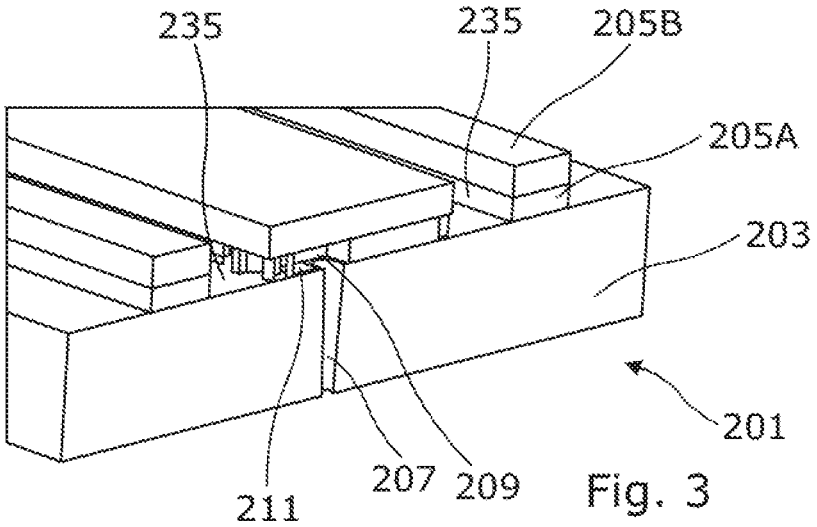
FIG. 3 illustrates a perspective view on a portion of an example of a fluid ejection die.
Figure 4:
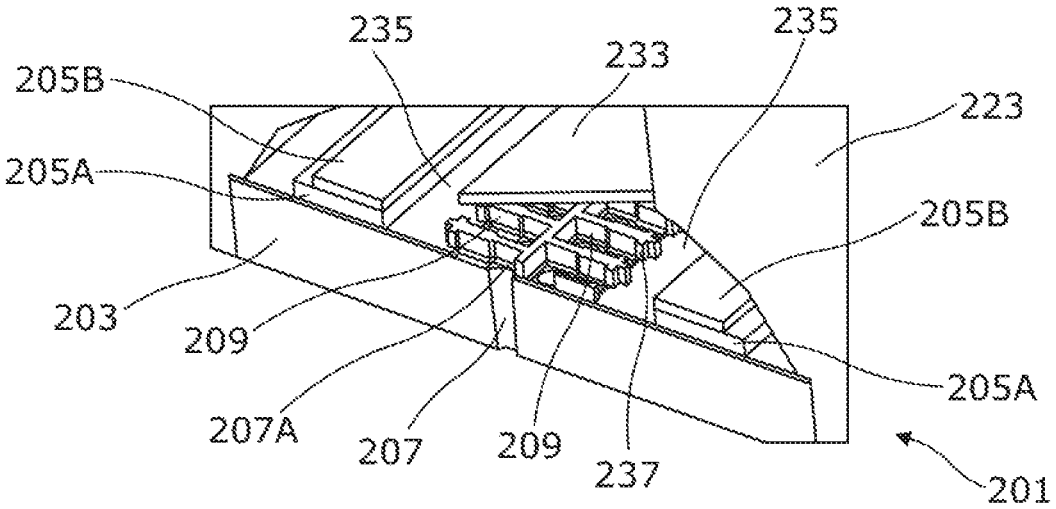
FIG. 4 illustrates a different, partially cross sectional, perspective view on a portion of the example fluid ejection die of FIG. 3.
Figure 5:
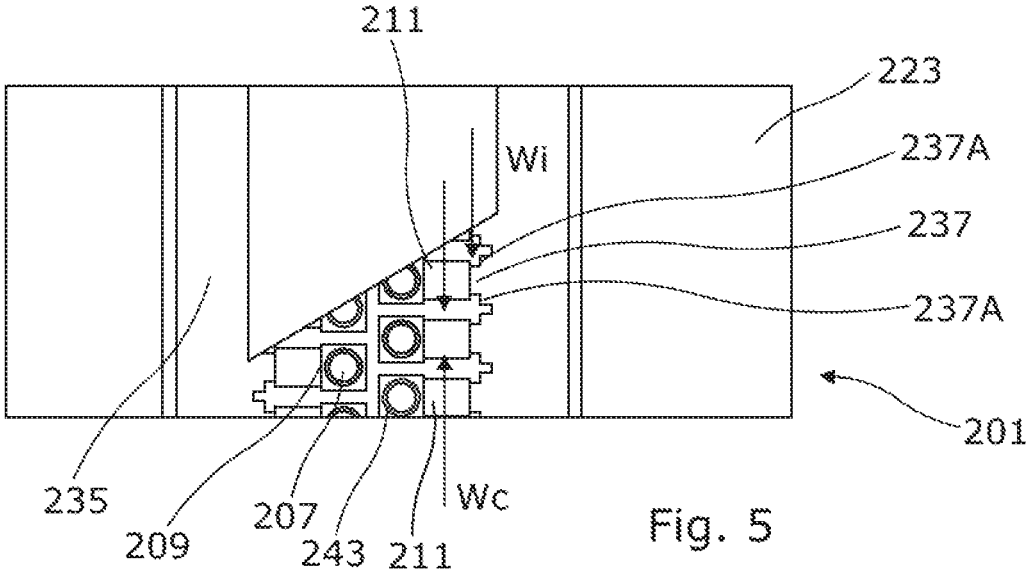
FIG. 5 illustrates a partially cross sectional top view on a portion of the example fluid ejection die of FIGS. 3 and 4.
Figure 6:
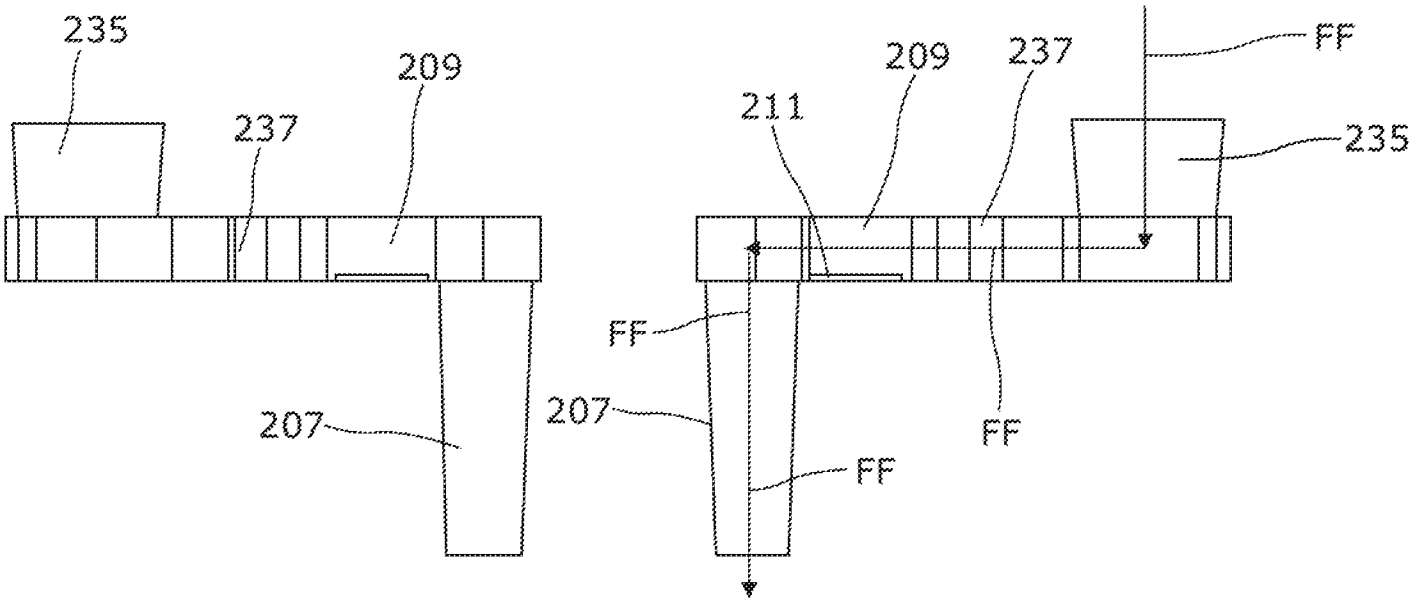
FIG. 6 illustrates a side view of a fluid path and resistor of the example fluid ejection die of FIGS. 3-5.

FIGS. 3-5 illustrate a portion of an example fluid ejection die 201. The example die 201 is illustrated with an example packaging 223 in FIGS. 4 and 5. FIG. 6 illustrates a corresponding fluid flow path. The fluid ejection die 201 may be for ejecting a single fluid type, for example a single color ink, wherein the illustrated two nozzle columns may be to eject the same fluid as provided by the same fluid slot 233.

The die 201 includes a substrate 203 and fluidic thin film layers 205A, 205B on the substrate 203. The substrate 203 includes nozzles 207 through the entire thickness of the substrate 203. A thin film chamber layer 205A may be provided onto the substrate 203. The thin film chamber layer 205 includes an array of chambers 209, for example two columns of chambers 209. The chambers 209 are fluidically connected to the nozzles 207. Actuators 211 such as heat resistors may be disposed in the chamber layer 205, in each of the chambers 209. A fluid supply layer 205B extends upstream of the chamber layer 205A. Fluid supply channels such as manifold channels 235 extend through the fluid supply layer 205B and the chamber layer 205A, to fluidically connect an external fluid supply slot 233 to each of the chambers 209. The illustrated opposite manifold channels 235 connect to the same fluid supply slot 233. In other examples, instead of a single manifold channel 235 connecting to a full column of chambers 209, single discrete fluid supply holes may be provided in the fluid supply layer 205B to connect the external fluid supply slot 233 to the individual chambers 209. In yet other examples multiple discrete manifold channels connect to smaller groups of chambers within the full column of chambers.

Inlets 237 are provided between the manifold channel 235 and each chamber 209 of a corresponding column of chambers 209. In this example, the inlets 237 extend laterally to a length of the manifold channel 235 and laterally to a length of the column of chambers 209. The manifold channels 235 connected to the chamber columns extend along the outer sides of the chamber columns, so that both chamber columns extend between the manifold channels 235. Also the nozzles columns associated with respective chamber columns extend at the inner sides of the manifold channels 235, as seen from a top view (FIG. 5). Hence, within the die 201, the fluid is supplied to each nozzle column 207A from separate fluid channels 235 that extend at laterally outer sides of the nozzle columns.

The actuator 211 may extend between the inlet 237 and the nozzle 207. In an example fluid ejection scenario, fluid may flow downwards from the fluid slot 233 into the manifold channels 235. The fluid flow may split into multiple flows to enter multiple parallel manifold channels 235, two of which are shown in the die of FIGS. 3-5. Referring to FIG. 6, the fluid may flow downwards through each manifold channel 235, as illustrated by fluid flow direction FF. At a bottom of each manifold channel 235 the fluid changes course, flowing laterally into individual chambers 209, over respective actuators 211. Each actuator 211 may pressurize the fluid in the chamber 209, for example by heat or vibration, whereby the fluid is pushed out of the chamber 209, again changing course, this time in a downwards direction through the nozzle opening 207 in the substrate 203, from where it is ejected out of the die 201. As illustrated in FIG. 6, opposite nozzles 207 of opposite nozzle columns may extend closer to each other than opposite chambers 209 of opposite chamber columns and opposite fluid supply inlets 237. The manifold channels 235 may extend at lateral outer sides of the illustrated opposite fluidic paths. The two separate fluidic paths diverge to each other, through the inlets 237 and chambers 209, to the opposite nozzle columns. In other example certain fluid supply channels other than longitudinal manifold channels may be provided, such as for example columns of discrete fluid supply holes, each fluid supply hole connected to a chamber and the chamber column and fluid supply hole column extending parallel to each other, wherein the fluid supply hole columns may similarly extend laterally and externally along the chamber columns.

In the illustrated example, the actuators 211 extends between the inlet 237 of the chamber 209 and the nozzle 207. The nozzle 207 opens into a wall 243 of the chamber 209, forming a nozzle inlet 207A in said wall 243. The actuator 211 is disposed on the substrate 203, next to and on the same chamber wall 243 as the nozzle inlet 207A. In the illustrated example, wherein the die 201 may be configured for downwards fluid ejection, the actuator 211 and nozzle inlet 207A are provided on and in, respectively, the floor of the ejection chamber 209. For example electrode traces or further thin film layer portions may extend between the actuator 211 and the substrate 203. At least one other thin film layer, such as a passivation layer may extend over the resistor 211.

In the illustrated example, the fluid inlets 237 of the chambers 209, between the manifold channels 235 and the chambers 209, include projections 237A that extend into fluid channel between the manifold channel 235 and the chamber 209. The projections define, and narrow, an inlet width Wi. The width Wi of the inlet 237, between the projections 237A, may be less than an average chamber width We of the chamber 209, wherein the width We of the chamber 209 is defined as parallel to the width Wi.

Figure 5A:
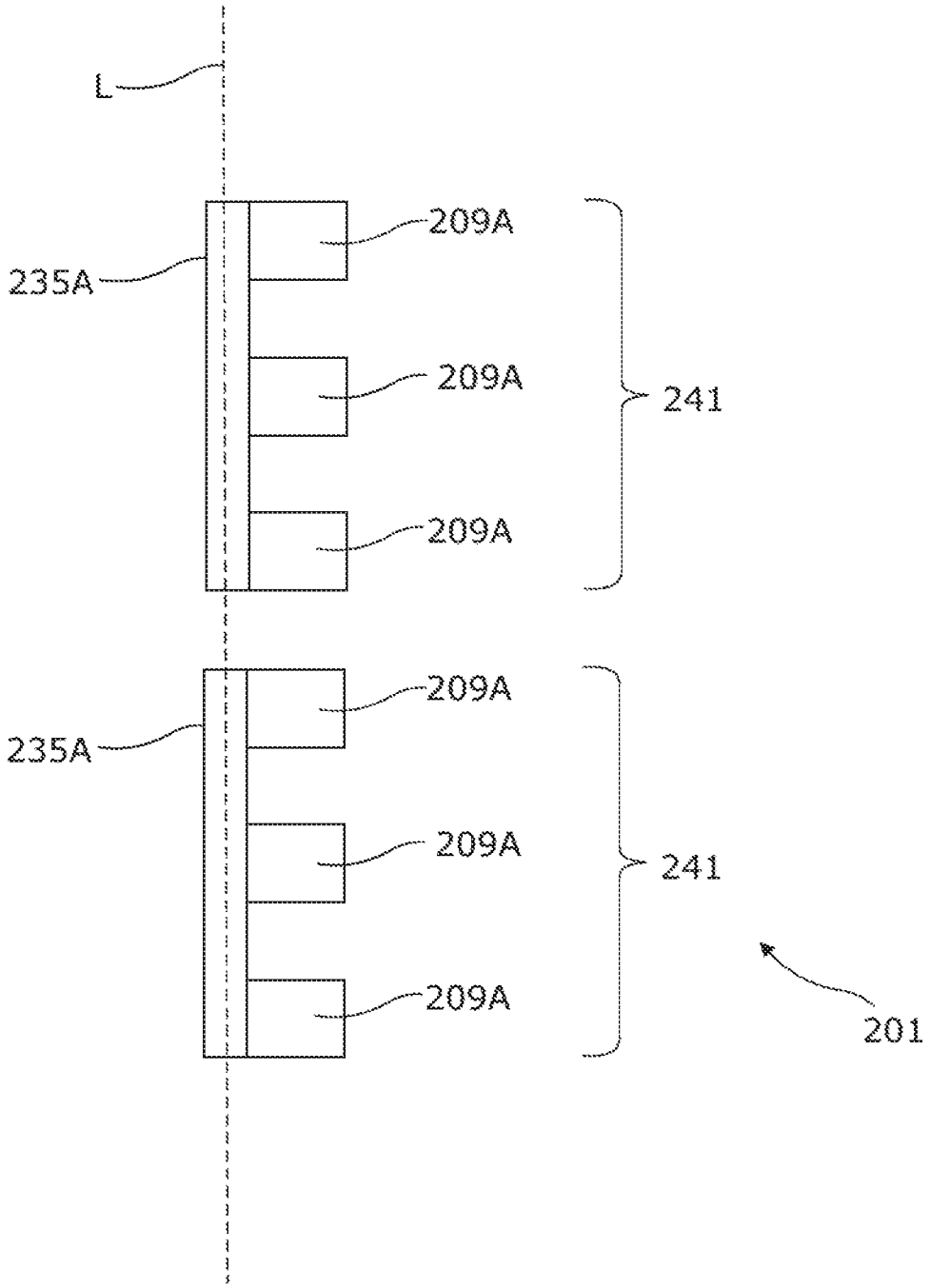

As explained above, instead of a single manifold channel 235, other fluid supply channel arrangements can be used to supply fluid from a fluid supply slot 233 external to the die 201 to the individual chambers 209. As illustrated in FIG. 5A, multiple in-line manifold channels 235A parallel to the chamber column may extend in line with each other, along one axis L, wherein each of the in-line manifold channels 235A fluidically connects to a sub-column of chambers 209A and wherein each sub-column 241 is part of the same larger column of chambers 209A. Hence each sub-column 241 is fluidically disconnected within the die 201. Each sub-column 241 may contain at least two chambers 209A. In again a different example, individual fluid supply holes are formed through the thin film layers 205 to guide fluid from an external fluid supply slot to each of the individual chambers whereby the fluid supply holes may be fluidically disconnected within the die 201.

FIGS. 7-10 illustrate diagrams of different examples of top views of drop generators 345, 445, 545, 645, each drop generator 345, 445, 545, 645 including an ejection chamber 309, 409, 509, 609, nozzle 307, 407, 507, 607, chamber inlet 337, 437, 537, 637, inlet projections 337A, 437A, 537A, 637A and at least one actuator 311, 411, 511, 611. In an example the actuator 311, 411, 511, 611 is disposed on the same wall as an inlet of the nozzle 307, 407, 507, 607. In an example the actuator 311, 411, 511, 611 is a thermal resistor to heat fluid to eject the fluid. The nozzle 307, 407, 507, 607 runs through the substrate as described in other examples of this disclosure. A fluid supply channel 335, 435, 535, 635 is to provide fluid to each chamber 309, 409, 509, 609 through the respective inlet 337, 437, 537, 637. At least one thin film layer 305, 405, 505, 605 extends around the chambers 309, 409, 509, 609 and inlets/channels 337, 437, 537, 637, 335, 435, 535, 635. The top view may be onto an upstream side of a substrate, onto which the at least one thin film layer 305, 405, 505, 605 and actuator 311, 411, 511, 611 are disposed. Instead of, or in addition to, the inlet projections 337A, 437A, 537A, 637A at least one of baffles, bubble tolerant architectures and particle tolerant architectures may be formed in or near the inlet 337, 437, 537, 637.

Figure 7:
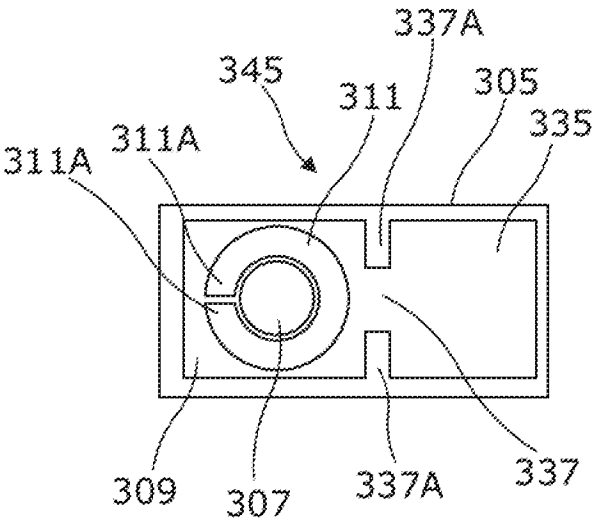

FIG. 7 illustrates an example of a drop generator 345 wherein the actuator 311 is disposed around the nozzle 307, substantially donut-shaped, covering almost a full circle wherein opposite ends 311A are disconnected. These ends 311A may extend close to each other. Electrodes may contact each end of the actuator 311 for actuation. In different examples the actuator 311 may cover at least 270 degrees around the nozzle 307, or at least 345 degrees, and less than approximately 358 degrees, or less than approximately 350 degrees. In another example the actuator 311 could be circular shaped and cover a full circle whereby opposite electrodes may contact the inner and outer edges of the actuator 311, or opposite outer edges of the actuator 311 on opposite sides of the nozzle 307.

Figure 8:
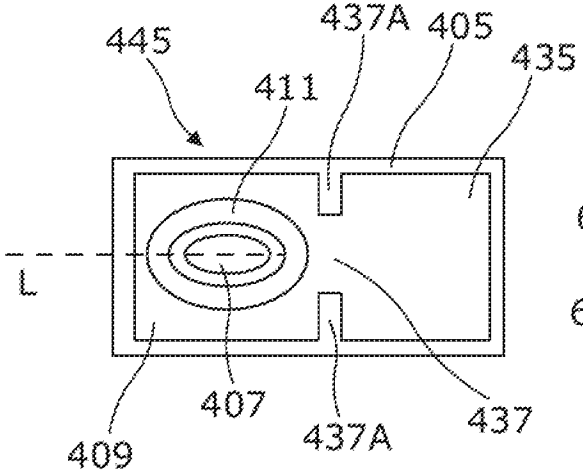

FIG. 8 illustrates an example of a drop generator 445 wherein the nozzle 407 is non-circular shaped. For example the nozzle 407 is symmetrical along a longitudinal axis L. The nozzle 407 may have a substantially longitudinal shape along said axis L, and/or an elliptical shape whereby a length direction of the ellipse extends along the longitudinal axis L. The actuator 411 may extend around the nozzle 407 wherein the inner and outer edge of the actuator 411 may be offset from the circumference of the inlet of the nozzle 407. In different examples the actuator 411 may extend fully or partially around the nozzle 407. For example the actuator 411 may be interrupted so as to be defined by four separate actuators 411.

Figure 9:
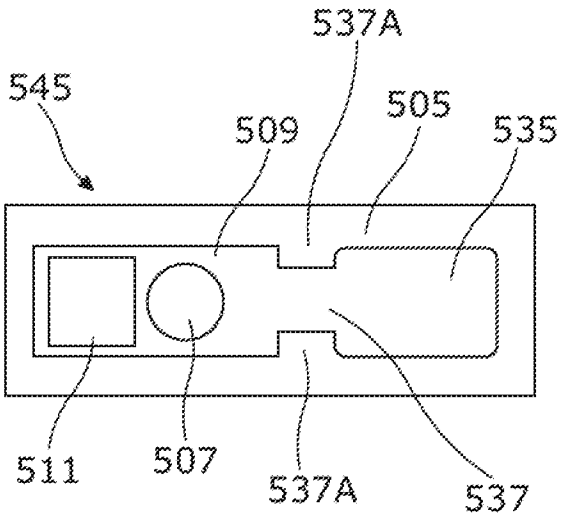
FIGS. 7-10 illustrate diagrams of different example configurations of drop generators including resistors and nozzles.
Figure 10:
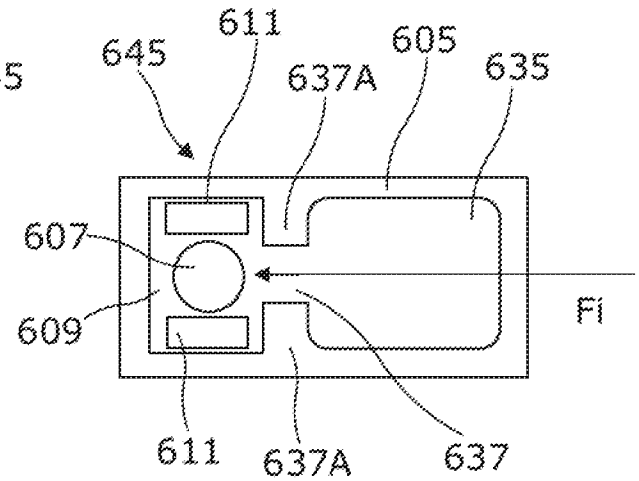

FIG. 9 illustrates an example wherein the actuator 511 extends next to the nozzle 507 on an opposite side of the nozzle 507 with respect to the chamber inlet 537. In another example, two resistors could be disposed along opposite sides of the nozzle 507, for example one resistor as shown in FIG. 9 and another resistor between the nozzle 507 and the inlet 537, as shown in FIG. 5. In yet another example a single resistor may extend along one side of the nozzle 507, between the nozzle 507 and the inlet 537, as shown in FIG. 5. FIG. 10 illustrates an example wherein the actuator 611 extends on opposite sides of the nozzle 607. The actuators 611 may extend laterally to the nozzle 607 with respect to a fluid in-flow direction Fi in the inlet 637. In other examples more than two separate actuators may extend around the nozzle, at different sides of the nozzle. In again other examples, different shapes, numbers and locations of actuators can be chosen to extend next to, and/or at least partially around, a single nozzle, and on the same wall as the nozzle inlet.

Figure 11:
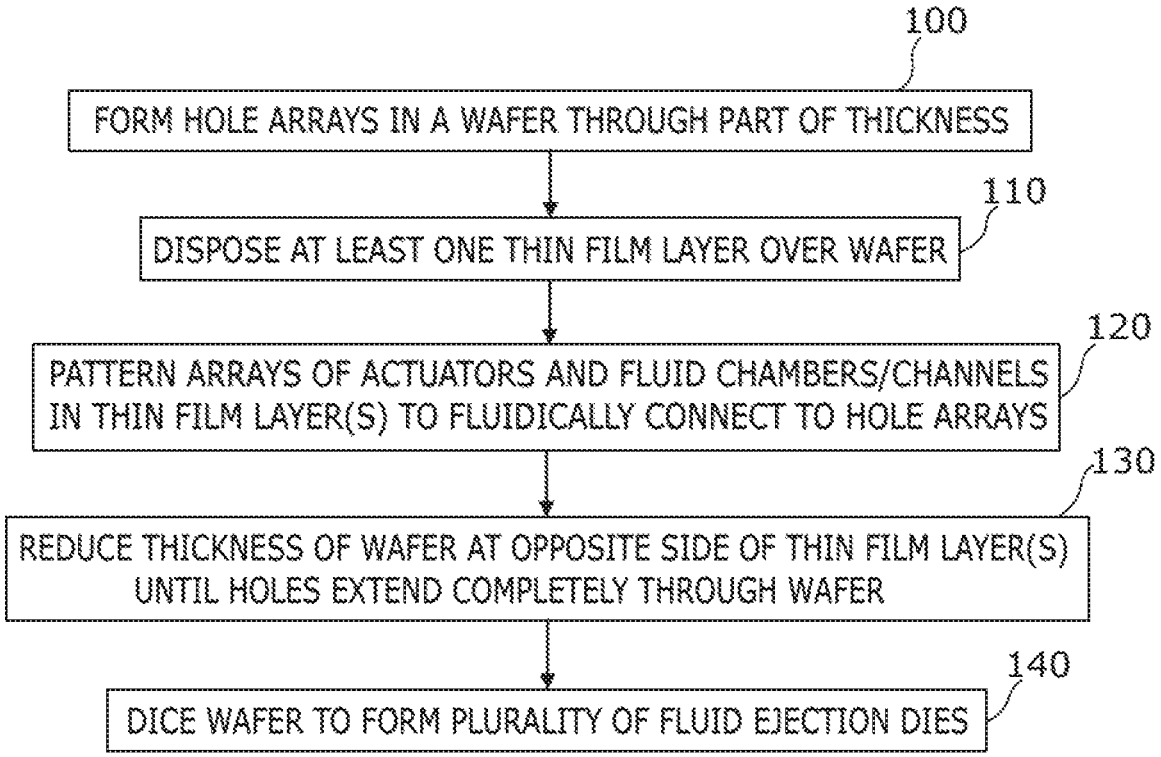
FIG. 11 illustrates a method of manufacturing a fluid ejection die.
Figure 12:
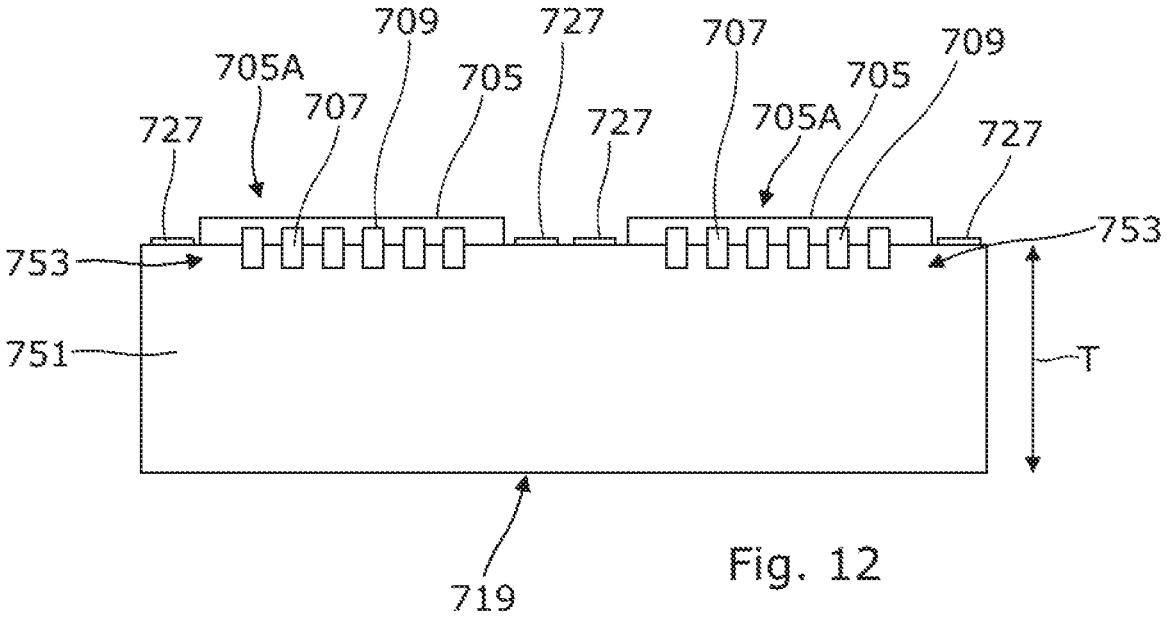
FIG. 12 illustrates an example of wafer and thin film layers for manufacturing a fluid ejection die.
Figure 13:
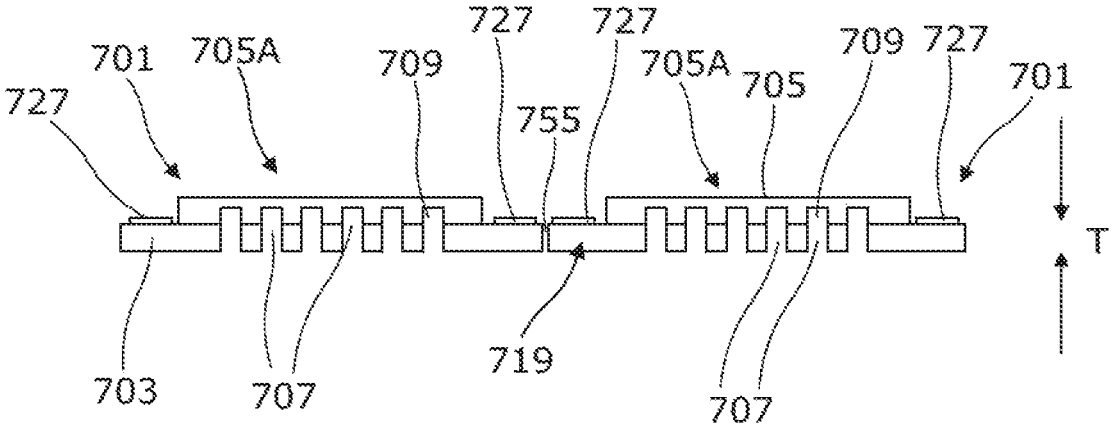
FIG. 13 illustrates the example wafer and thin film layers of FIG. 12 in a later manufacturing stage.

FIG. 11 illustrates a flow chart of an example method of manufacturing a fluid ejection die 701 of this disclosure. FIGS. 12 and 13 illustrate examples of intermediate products of such method. The method of FIG. 10 includes forming hole arrays 753 in a wafer 751 through part of a thickness T of the wafer 751 (block 100). In one example the wafer 751 includes silicon. In one example the hole array is formed by using a photoresist to define nozzle patterns in the wafer, and then dry etch, for example by deep reactive-ion etching.

The method further includes disposing at least one thin film layer 705 onto the wafer 751 (block 110). The method further includes patterning arrays of fluidic actuators and fluidic chambers 709/channels in the at least one thin film layer 705, so that the chambers 709/channels fluidically connect to the hole array 753 (block 120). Forming the fluidic chambers 709 and channels may be achieved by patterning and etching, for example after filling the hole array 753 with a protective sacrificial material, e.g. wax or other material, after which filling at least one thin film may be laminated over and/or between the protective material.

Separate thin film devices 705A, each formed of said thin film layers 705, may spread like a grid over the wafer 751, to connect to corresponding separate hole arrays 753, and to form part of respective fluid ejection dies 701. FIG. 12 illustrates a diagrammatic example of an intermediate product in this stage of the manufacturing method. In a further example, electrical circuitry is patterned in/on the thin film layers 705 wherein the electrical circuitry may include electrical bond pads 727 that extend next to the thin film layers 705, for example near dicing lines 755 of the wafer 751, to later connect to further electrical components outside of the die 701.

The method further includes reducing a Thickness T of the wafer 751 at the opposite side 719 (downstream side), i.e. opposite with respect to the at least one thin film layer 705. In the method, the thickness T may be reduced until the holes are completely exposed at said opposite side 719 so that the holes extend completely through the wafer 751 to form ejection nozzles 707 (block 130). In one example the wafer 751 is ground to its end thickness. In a further example, the downstream wafer side 719 is finished with dry polishing after it has been reduced in thickness. In one example the thickness of the substrate 703 and correspondingly the depth of the nozzles 707 is between approximately than 10 and approximately 100 micron, for example between 12 and 80 micron, for example between 15 and 60 micron or for example between approximately 20 and approximately 40 micron. In certain examples the nozzles have counter bores around their outlets, i.e., a stepped outlet, for example to reduce an effective depth of the nozzle with respect to T thickness T of the thinned substrate.

In an example, at least one thin film layer 705 extends over the nozzle 707, e.g., forming a roof of an ejection chamber 709 over the nozzle 707. The method further includes dicing the wafer 751 over said dice lines 755 to form a plurality of fluid ejection dies 701 (block 140). In one example the wafer 751 is diced between the thin film fluidic devices 705A, for example near electrical contact pads 727 that will after dicing extend near an edge of each fluid ejection die 701. FIG. 13 illustrates a diagrammatic example of an intermediate product after such dicing.

Figure 14:
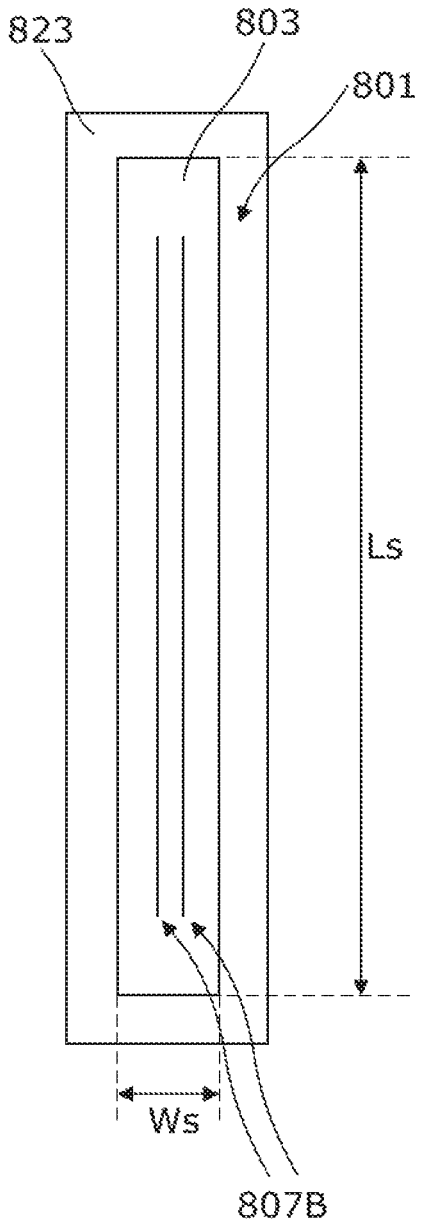
FIG. 14 illustrates a diagram of an example of a fluid ejection die in a packaging.

Some of the examples of this disclosures are thin sliver dies, having a substrate of reduced thickness t2, T (e.g. FIG. 1, 13) and a relative thin thin film layer stack. The combined thickness t (e.g. FIG. 1, 13) of the substrate t2, T and the thin film layers t1 can be less than approximately 300 micron, less than approximately 200 micron or less than approximately 100 micron. As illustrated by FIG. 14 a thin sliver die 801 of this disclosure that has a substrate 803 as nozzle plate may have a relatively narrow width Ws, for example less than 5 millimeters, less than 3 millimeters, less than 1.5 millimeters, less than 1 millimeter or less than 0.5 millimeters. A ratio length Ls:width Ws of the die 801 can be relatively high, for example at least approximately 50:1. The length Ls and width Ws may be measured between outer edges of the die substrate 803. At least one nozzle columns 807B may extend parallel to the length direction. The illustrated example die 801 includes two nozzle columns 807B through the substrate 807B. The thin die 801 may be reinforced by the packaging 823, for example by embedding or overmolding the die 801 in packaging compound.

A fluidic MEMS of this disclosure may have any combination of the described features and effects. In one aspect a MEMS can include a die. The die may include (i) a substrate including an array of nozzles extending through the substrate and (ii) thin film layers on the substrate, including fluid ejection actuators associated with the nozzles. The thin film layers may include ejection chambers associated with the nozzles. The thin film layers may further include an array of fluid inlets to supply fluid to these chambers.

The substrate may form or support a wall of the ejection chamber, wherein a nozzle inlet opening is formed in the wall. Each actuator may be disposed on the same wall as the nozzle inlet opening, for example next to the nozzle inlet opening. In one example the actuator is a heat resistor to form a vapor bubble in fluid. In other examples the actuator may be any other type of fluid dispensing actuator such as a piezo actuator. For example at least a portion of the actuator is disposed between the chamber inlet and the nozzle inlet. In a further example the actuator is disposed at least partially around or at multiple sides of the nozzle inlet opening.

In a further example, the substrate includes two parallel nozzle columns, wherein separate columns of ejection chambers and fluid supply inlets are associated with each nozzle column, and wherein these columns are fluidically disconnected from each other in the die. In one example, fluid supply inlets to each ejection chamber extend at lateral outer sides of the ejection chamber column. For example fluid supply holes may extend at lateral outer sides of the inlet column, through the thin film layers, to supply fluid to the chambers through each inlet.

In one example the thin film layers include ( ) electrical circuitry, and (ii) electrical contacts connected to the electrical circuitry, for connection to drive circuitry external to the die. The electrical contacts can be disposed at the thin film layer side of the substrate, for example near at least one edge of the substrate to readily connect the electrical circuitry to said external drive circuitry. In a further example a packaging is provided to package the die. The packaging may including at least one fluid supply slot to supply fluid to the fluid supply inlets. For example fluid supply holes may fluidically connect the slot to the inlets. Thin film layers extend between at least one of (i) the packaging and the substrate, and (ii) the fluid supply slot and the substrate. In a further example the external drive circuitry is provided in or on the packaging.

In a further example, the die includes (i) a pair of parallel nozzle columns to eject fluid, (ii) at least one first fluid supply hole to let fluid into the die to supply fluid to at least one ejection chamber associated with a first of the pair of nozzle columns, and (iii) at least one second supply hole to let fluid into the die to supply fluid to ejection chambers associated with a second of the pair of nozzle columns. The first and second fluid supply holes are fluidically connected to the same at least one fluid supply slot. In one example a lateral distance between said nozzle columns is smaller than a lateral distance between said first and second fluid supply holes. The first fluid supply hole associated with a first nozzle column can be either (i) a column of discrete supply holes connected to single chamber inlets or sub-groups of chamber inlets, or (ii) an single elongate fluid supply hole connected to a column of chamber inlets. The manifold channel 235 illustrated in the example of FIGS. 3-5 is an example of an elongate fluid supply hole in the thin film layers. In different examples, a fluid supply slot of the packaging can supply fluid to the at least one fluid supply hole in the thin film layers.

In one example a depth of the nozzles is more than a thickness of the thin film layers, and the sum of that depth and thickness approximately equals the total thickness of the die. In a further example the thickness of the die is less than approximately 300 micron.

In a further aspect this disclosure provides for a method of manufacturing fluid ejection dies. Such method may include (i) forming hole arrays in a wafer through part of its thickness, (ii) disposing at least one thin film layer over the wafer, (Iii) patterning arrays of fluidic actuators and fluid chambers/channels in said at least one thin film layer to fluidically connect to the hole arrays, (iv) reducing a thickness of the wafer at opposite side with respect to the at least one thin film layer until holes extend completely through the wafer to form ejection nozzles, and (v) dicing the wafer to form a plurality of fluid ejection dies.

What is claimed is:

1. A fluid ejection die comprising:

a substrate including an array of nozzles, each nozzle of the array of nozzles extending through the substrate; and thin film layers on the substrate, the thin film layers including ejection chambers and fluid ejection actuators associated with the nozzles, wherein the ejection chambers are outside of the substrate, and each respective fluid ejection actuator of the fluid ejection actuators is disposed in a respective ejection chamber of the ejection chambers, and the respective fluid ejection actuator is upstream of an associated nozzle of the nozzles and is outside of the substrate through which the associated nozzle extends from an upstream side of the substrate to a fluid ejection die head surface of the substrate from which a fluid that has passed through the associated nozzle is to be ejected.

2. The fluid ejection die of claim 1, wherein the thin film layers include an array of fluid supply inlets to supply fluid to the ejection chambers.

3. The fluid ejection die of claim 2, wherein the substrate forms or supports a wall of a first ejection chamber of the ejection chambers, the wall having a nozzle inlet opening to the first ejection chamber.

4. The fluid ejection die of claim 3, wherein a first fluid ejection actuator of the fluid ejection actuators is disposed on the wall.

5. The fluid ejection die of claim 4, wherein the first fluid ejection actuator is disposed next to the nozzle inlet opening.

6. The fluid ejection die of claim 5, wherein the first fluid ejection actuator is disposed at least partially around or at multiple sides of a respective nozzle.

7. The fluid ejection die of claim 2, wherein a first fluid supply inlet to a first ejection chamber extends at a lateral outer side of a first ejection chamber.

8. The fluid ejection die of claim 1, wherein the thin film layers include electrical circuitry, and electrical contacts connected to the electrical circuitry, for connection to drive circuitry external to the fluid ejection die.

9. The fluid ejection die of claim 1, wherein the substrate has a full thickness, and the respective fluid ejection actuator is outside of the full thickness of the substrate.

10. A fluid ejection die comprising:

a substrate including an array of nozzles extending through the substrate;

thin film layers on the substrate, the thin film layers comprising:

ejection chambers associated with the nozzles, fluid ejection actuators associated with the nozzles, and an array of fluid supply inlets to supply fluid to the ejection chambers; and parallel nozzle columns, wherein a separate set of ejection chambers and fluid supply inlets is associated with each nozzle column of the parallel nozzle columns, wherein the separate sets of ejection chambers and fluid supply inlets are fluidically disconnected from each other in the fluid ejection die.

11. A fluid ejection die comprising:

a substrate including an array of nozzles extending through the substrate; and thin film layers on the substrate, including fluid ejection actuators associated with the nozzles, wherein a depth of the nozzles is more than a thickness of the thin film layers, and a sum of the depth and the thickness approximately equals a total thickness of the fluid ejection die.

12. The fluid ejection die of claim 11, wherein the total thickness of the fluid ejection die is less than 300 microns.

13. The fluid ejection die of claim 11, wherein the thin film layers include ejection chambers associated with the nozzles.

14. A fluid ejection device comprising:

a fluid ejection die;

a packaging to package the fluid ejection die, the packaging including at least one fluid supply slot to supply fluid to the fluid ejection die, the fluid ejection die comprising:

a substrate including an array of nozzles, each nozzle of the array of nozzles extending through the substrate, the substrate comprising an upstream side and a fluid ejection die head surface; and thin film layers on the substrate, the thin film layers including ejection chambers and fluid ejection actuators associated with the nozzles, wherein the ejection chambers are outside of the substrate, and each respective fluid ejection actuator of the fluid ejection actuators is disposed in a respective ejection chamber of the ejection chambers, and the respective fluid ejection actuator is upstream of an associated nozzle of the nozzles and is outside of the substrate through which the associated nozzle extends from the upstream side to the fluid ejection die head surface from which a fluid that has passed through the associated nozzle is to be ejected.

15. The fluid ejection device of claim 14, comprising:

parallel nozzle columns to eject fluid, a first fluid supply hole to let fluid into the fluid ejection die to supply fluid to at least one ejection chamber associated with a first of the nozzle columns, a second supply hole to let fluid into the fluid ejection die to supply fluid to at least one ejection chamber associated with a second of the nozzle columns, the first and second fluid supply holes fluidically connected to the at least one fluid supply slot, wherein a lateral distance between the nozzle columns is smaller than a lateral distance between the first and second fluid supply holes.

16. The fluid ejection device of claim 14, wherein the thin film layers include an array of fluid supply inlets to supply fluid to the ejection chambers.

17. The fluid ejection device of claim 16, wherein the substrate forms or supports a wall of a first ejection chamber of the ejection chambers, the wall having a nozzle inlet opening to the first ejection chamber.

18. The fluid ejection device of claim 17, wherein a first fluid ejection actuator of the fluid ejection actuators is disposed on the wall.

19. The fluid ejection device of claim 14, wherein a depth of the nozzles is more than a thickness of the thin film layers, and a sum of the depth and the thickness approximately equals a total thickness of the fluid ejection die.

20. The fluid ejection device of claim 19, wherein the total thickness of the fluid ejection die is less than 300 microns.

* * * * *